US006497847B2

(12) United States Patent
Foster et al.

(10) Patent No.: US 6,497,847 B2
(45) Date of Patent: Dec. 24, 2002

(54) CATALYTIC CONVERTER END PLATE INLET/OUTLET PLENUM LENGTH RATIO

(75) Inventors: Michael Ralph Foster, Columbiaville, MI (US); Scott Christopher Blanchet, Bethel, CT (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/178,793

(22) Filed: Oct. 26, 1998

(65) Prior Publication Data

US 2002/0037241 A1 Mar. 28, 2002

(51) Int. Cl.[7] ..... B01D 53/92; F01N 3/28
(52) U.S. Cl. ..... 422/177; 422/171; 422/180
(58) Field of Search ..... 422/171–172, 422/174, 177, 180, 176; 60/299, 300; 181/244, 264

(56) References Cited

U.S. PATENT DOCUMENTS

| | | | | |
|---|---|---|---|---|
| 3,163,256 A | | 12/1964 | Lanning | 181/56 |
| 3,189,418 A | | 6/1965 | Gary | 422/180 |
| 4,559,205 A | | 12/1985 | Hood | 422/180 |
| 5,016,438 A | * | 5/1991 | Harris | 422/180 |
| 5,187,142 A | | 2/1993 | Richmond et al. | 502/428 |
| 5,330,728 A | | 7/1994 | Foster | 422/177 |
| 5,488,826 A | | 2/1996 | Paas | 60/299 |
| 5,693,295 A | | 12/1997 | Foster | 422/180 |
| 5,766,559 A | | 6/1998 | Blanchet et al. | 422/171 |
| 5,804,147 A | | 9/1998 | Blanchet et al. | 422/171 |

OTHER PUBLICATIONS

Ser. No. 08/932,713, Filed Sep. 17, 1997, Inventor: Foster et al., assigned to the assignee of this invention.
Ser. No. 08/943,847, Filed Oct. 3, 1997, Inventor: Foster, assigned to the assignee of this invention.
Ser. No. 09/003,943, Filed Jan. 8, 1998, Inventor: Foster, assigned to the assignee of this invention.
Ser. No. 09/094,861, Filed Jun. 15, 1998, Inventor: Foster, assigned to the assignee of this invention.
Ser. No. 09/141,299, Filed Aug. 27, 1998, Inventor: Foster et al., assigned to the assignee of this invention.
Ser. No. 09/144,481, Filed Aug. 31, 1998, Inventor: Foster et al., assigned to the assignee of this invention.

* cited by examiner

*Primary Examiner*—Hien Tran
(74) *Attorney, Agent, or Firm*—Vincent A. Cicnosz

(57) ABSTRACT

A catalytic converter of the type having an inlet plenum between a converter inlet and an axial inlet face of a substrate and an outlet plenum between a converter outlet and an axial outlet face of the substrate, wherein a first axial length of the inlet plenum is in a range of 20–40% of the first axial length of the inlet plenum summed with a second axial length of the outlet plenum to minimize flow resistance in said catalytic converter.

7 Claims, 3 Drawing Sheets

| RUN | %IN | TOTAL GAP (mm) | IN (mm) | OUT (mm) | MEAS. DP ("$H_2O$) |
|---|---|---|---|---|---|
| 1 | 20% | 15 | 3 | 12 | 7.7 |
| 2 | 40% | 15 | 6 | 9 | 7.79 |
| 3 | 50% | 15 | 7.5 | 7.5 | 7.92 |
| 4 | 60% | 15 | 9 | 6 | 8.19 |
| 5 | 80% | 15 | 12 | 3 | 8.88 |
| 6 | 20% | 25 | 5 | 20 | 7.33 |
| 7 | 40% | 25 | 10 | 15 | 7.29 |
| 8 | 50% | 25 | 12.5 | 12.5 | 7.39 |
| 9 | 60% | 25 | 15 | 10 | 7.57 |
| 10 | 80% | 25 | 20 | 5 | 8.25 |
| 11 | 20% | 35 | 7 | 28 | 7.09 |
| 12 | 40% | 35 | 14 | 21 | 7.06 |
| 13 | 50% | 35 | 17.5 | 17.5 | 7.1 |
| 14 | 60% | 35 | 21 | 14 | 7.22 |
| 15 | 80% | 35 | 28 | 7 | 7.89 |
| 16 | 20% | 50 | 10 | 40 | 6.97 |
| 17 | 40% | 50 | 20 | 30 | 6.91 |
| 18 | 50% | 50 | 25 | 25 | 6.92 |
| 19 | 60% | 50 | 30 | 20 | 7 |
| 20 | 80% | 50 | 40 | 10 | 7.46 |
| 21 | 20% | 65 | 13 | 52 | 6.92 |
| 22 | 40% | 65 | 26 | 39 | 6.78 |
| 23 | 50% | 65 | 32.5 | 32.5 | 6.85 |
| 24 | 60% | 65 | 39 | 26 | 6.86 |
| 25 | 80% | 65 | 52 | 13 | 7.21 |
| 26 | 20% | 80 | 16 | 64 | 6.84 |
| 27 | 40% | 80 | 32 | 48 | 6.75 |
| 28 | 50% | 80 | 40 | 40 | 6.76 |
| 29 | 60% | 80 | 48 | 32 | 6.82 |
| 30 | 80% | 80 | 64 | 16 | 7.06 |

CATALYTIC CONVERTER END PLATE INLET/OUTLET PLENUM LENGTH RATIO

BACKGROUND OF THE INVENTION

1. Field of the Invention

The invention relates to catalytic converters. More particularly, the invention relates to optimizing back pressure in short plenum catalytic converters.

2. Prior Art

Traditionally, catalytic converters have had enough room under the vehicle to optimize plenum length for the application. A pair of plenums are important in a catalytic converter to let exhaust gasses from a relatively small diameter inlet pipe expand to flow through the catalyst channels and contract at the other end of the catalyst to enter the relatively small diameter outlet tube. A 50% split of the total plenum length (inlet plus outlet) between the inlet and outlet sides of the catalytic converter has been the standard for many years. Fifty percent of the total plenum length on the inlet side of the catalytic converter and fifty percent of the total plenum length on the outlet side of the catalytic converter is very effective as long as the total length can be engineered essentially without restriction. Commonly 80 millimeters or more has been used with a 50/50 split. This requires both that sufficient space is available and that materials cost allows for a longer converter.

With increasingly smaller cars having less room for catalytic converters and tighter control on materials cost, the plenum length must be reduced in newer vehicles. With reduced plenum lengths, back pressure is increased which can be significant in wide open throttle conditions relative to total horsepower and torque available in the drive train of the automobile. Equal plenum length, however, remains the standard.

SUMMARY OF THE INVENTION

An object of the invention is to reduce back pressure in a catalytic converter having a short total plenum length.

It is another object of the invention to reduce total cost for producing a catalytic converter through reduction of materials.

It is yet another object of the invention to produce a catalytic converter maintaining a high catalyst efficiency.

Advantageously, the particular construction of the invention employing unequal length input and output plenums in a catalytic converter accomplishes the foregoing objects of the invention.

Advantageously, according to a preferred example, this invention provides a catalytic converter of the type having an inlet plenum between a converter inlet and an axial inlet face of a substrate and an outlet plenum between a converter outlet and an axial outlet face of the substrate, wherein a first axial length of the inlet plenum is in a range of 20–40% of the first axial length of the inlet plenum summed with a second axial length of the outlet plenum to minimize flow resistance in said catalytic converter.

BRIEF DESCRIPTION OF THE DRAWINGS

The present invention will be described, by way of example only, with reference to the accompanying drawings in which.

DETAILED DESCRIPTION OF THE INVENTION

Figures 1, 2:
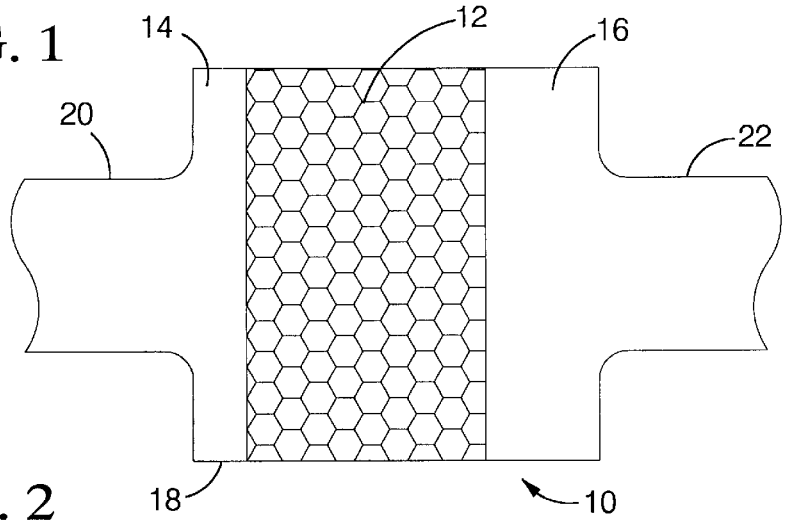
FIG. 1 is a schematic cross section view of a catalytic converter illustrating inlet and outlet plenums.
FIG. 2 is a chart of test runs indicating differing inlet percentage of total plenum length for various total lengths and the measured flow resistance in inches of water.

Referring to FIG. 1, the schematic representation of a catalytic converter 10 having catalyst 12 illustrates the inlet plenum 14 and outlet plenum 16 within outer housing 18 to render clear the teaching of the invention. The illustration is of an optimum one-third inlet, two-thirds outlet configuration which is but one preferred arrangement of the invention. One of skill in the art will recognize inlet pipe 20 and outlet pipe 22 (which each use a 10 mm radiused intersection with the end plate for the test runs of the application).

It has been discovered by the inventors hereof that an inlet plenum length of about one-third the total plenum length (inlet plenum length plus outlet plenum length) provides reduced fluid flow resistance (or back pressure) for fluid flowing through the catalytic converter.

Referring to FIG. 2, a chart is provided which displays measured data for thirty test runs undertaken employing six different total plenum lengths. The six subcategories are divided into five different ratios of inlet plenum length to outlet plenum length. The measured flow resistance in inches of water for each combination is set forth in the final column of the chart. As will be appreciated, most of the sets of data show a trend toward lower back pressure from the converter where inlet plenum lengths range from 20% to 40% of the total plenum length. This is especially true for the shorter total plenum length trials. In fact, by adapting a converter from a 50% split inlet to outlet plenum to a one-third, two-third inlet to outlet plenum, the total length required in the converter to have identical back pressure characteristics is about 5 mm shorter. It is axiomatic, then, that where the structure of the vehicle constrains the overall length of the catalytic converter to be used therewith, the invention may be employed to help keep back pressure to an acceptable value. Where the space is not a limiting factor, the invention may be employed to reduce the cost of the converter by reducing its length, which reduces the amount of material necessary to manufacture the catalytic converter.

Figure 3:
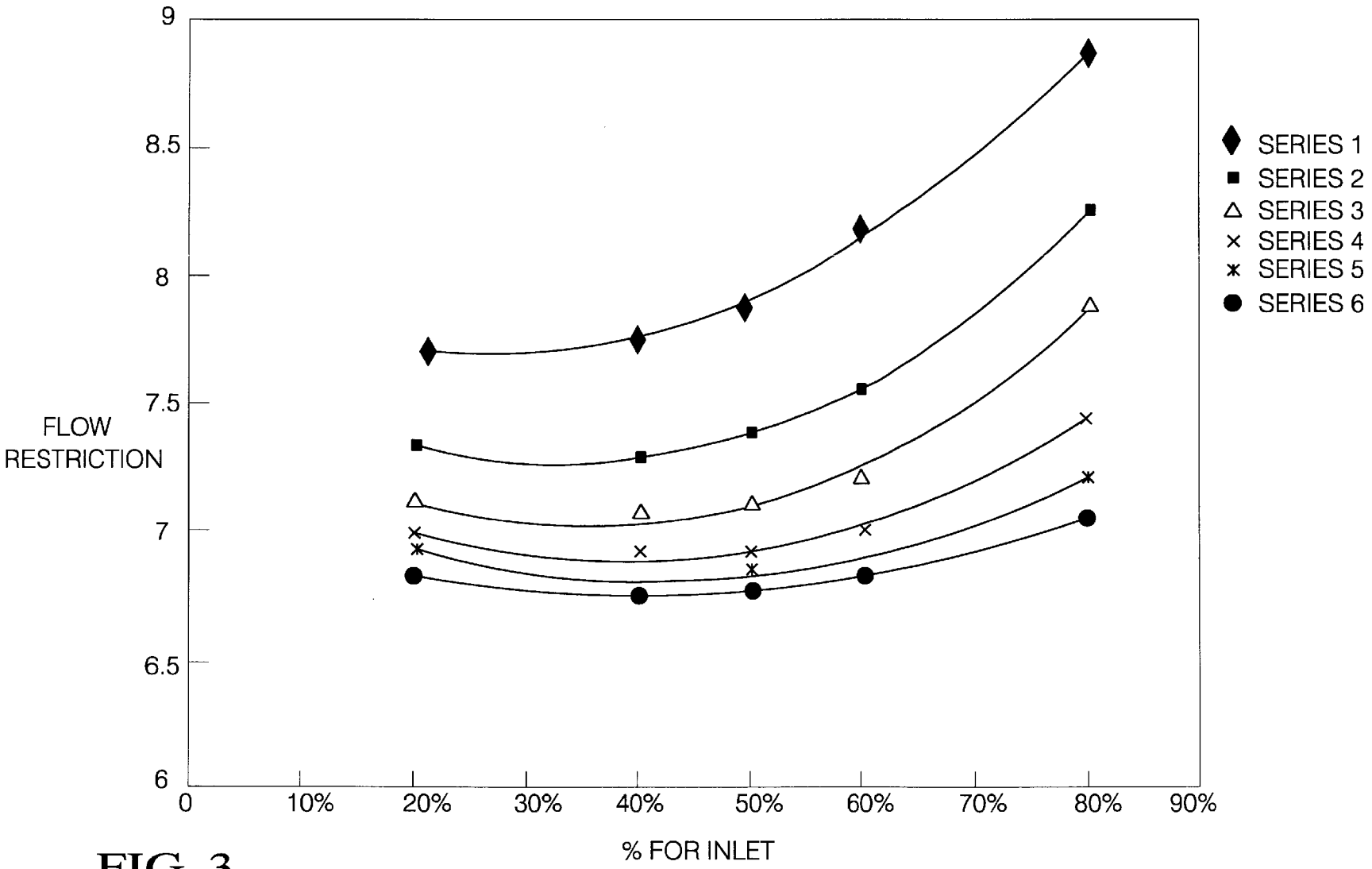
FIG. 3 is a graphic representation of the data set forth in FIG. 2 and a graphic representation of a curve produced by a linear regression analysis of the actual points.

Referring to FIG. 3, a graphic representation of the data presented in FIG. 2 clearly shows the invention has beneficial effects for all trials but shows marked improvement in reduction of back pressure in shorter overall plenum length catalytic converters. The various data points correspond directly to the data points listed in FIG. 2 and the curves represented are generated by linear regression analysis based upon the data points to approximate where all points would be measured. The Series 1 points represent data for the converter with a total inlet and outlet plenum length of 15 mm. The Series 2 points represent data for the converter with a total inlet and outlet plenum length of 25 mm. The Series 3 points represent data for the converter with a total inlet and outlet plenum length of 35 mm. The Series 4 points represent data for the converter with a total inlet and outlet plenum length of 50 mm. The Series 5 points represent data for the converter with a total inlet and outlet plenum length of 65 mm. The Series 6 points represent data for the converter with a total inlet and outlet plenum length of 80 mm. The equations for each line illustrated from uppermost to lowermost are respectively as follows:

$$y=3.9048x^2-1.9348x+7.931$$

$$y=4.4762x^2-2.9562x+7.746$$

$$y=4.3571x^2-3.0771x+7.547$$

$$y=3.2619x^2-2.4819x+7.347$$

$$y=2.7738x^2-2.2988x+7.269$$

$$y=2.0833x^2-1.7183x+7.101$$

Figure 4:
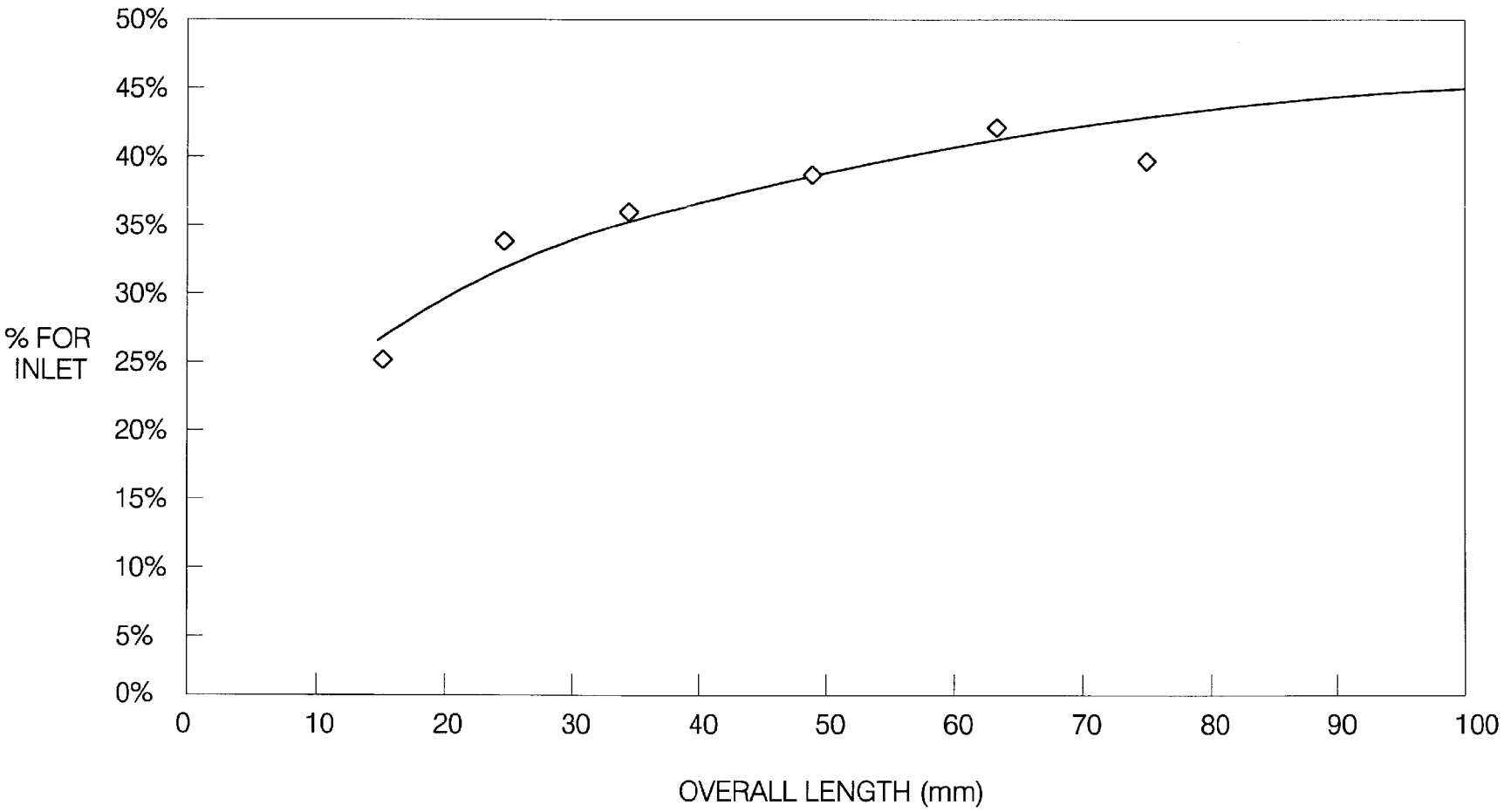
FIG. 4 is a graphic representation of inlet length percentage to total plenum length for minimum restriction.

The shortest overall plenum length of 15 millimeters, common in the contemporary more densely packed automobiles, shows significant improvement over a 50% split. FIG. 4 further confirms the significant effectiveness of the invention in shorter total plenum lengths by graphically plotting the minimum flow restriction for several iterations of the data. A subsequent linear regression analysis provides a simplified equation as set forth hereinbelow that provides consistently low flow restriction for different total plenum lengths. The curve provided starts relatively steeply rising and slows the rise dramatically as it passes the 80 millimeter length mark. The steep portion of the curve illustrates greatest gain.

To calculate the desired inlet plenum length for a particular total plenum length the following equation (resulting from the second linear regression analysis) is preferred:

inlet plenum length=total plenum length [0.1 Ln (Total Plenum Length)]

The result preferably is the median of a range defined by the result plus or minus 10% thereof.

As a general rule, the lowest flow restriction will be found when the inlet plenum length is about one-third of total plenum length.

In an example making good use of this invention, the inlet plenum length as measured from the inlet axial end interior converter wall to the inlet axial face of the converter substrate and the outlet plenum length as measured from the outlet axial end interior converter wall to the outlet axial face of the converter substrate sum to a total of 25 mm or less. In this example, the inlet plenum length is preferably 20–40 % of the sum of the plenum lengths, and most preferably is 25 to 35 % of the sum of the plenum lengths.

In another example, the inlet plenum length as measured from the inlet axial end interior converter wall to the inlet axial face of the converter substrate and the outlet plenum length as measured from the outlet axial end interior converter wall to the outlet axial face of the converter substrate sum to a total of 15 mm or less. In this example, the inlet plenum length is preferably 20–40 % of the sum of the plenum lengths, and more preferably is 25 to 35 % of the sum of the plenum lengths and most preferably 25–30% of the sum of the plenum lengths.

It will be understood that a person skilled in the art may make modifications to the preferred embodiment shown herein within the scope and intent of the claims. While the present invention has been described as carried out in a specific embodiment thereof, it is not intended to be limited thereby but is intended to cover the invention broadly within the scope and spirit of the claims.

What is claimed is:

1. A catalytic converter comprising:

a substantially linear outer housing having an inlet end and an outlet end;

a catalytic substrate having an inlet face and an outlet face disposed within said outer housing so that said inlet face is towards said inlet end;

wherein a first distance measured from said inlet end to said inlet face is about 20% to about 40% of a total distance, wherein said total distance is the sum of said first distance and a second distance measured from said outlet end to said outlet face.

2. The catalytic converter of claim 1, wherein said total distance is about 25 mm or less.

3. The catalytic converter of claim 1, wherein said total distance is about 15 mm or less.

4. The catalytic converter of claim 1, wherein said first distance is about one-third said total distance.

5. The catalytic converter of claim 4, wherein said total distance is about 25 mm or less.

6. The catalytic converter of claim 4, wherein said total distance is about 15 mm or less.

7. The catalytic converter of claim 1, wherein said first distance is calculated by:

first distance=total distance (0.1 Ln(total distance)).

* * * * *